US011254394B2

(12) United States Patent
König

(10) Patent No.: US 11,254,394 B2
(45) Date of Patent: Feb. 22, 2022

(54) PICK-UP DEVICE AND PICK-UP METHOD FOR A WATERCRAFT

(71) Applicants: thyssenkrupp Marine Systems GmbH, Kiel (DE); thyssenkrupp AG, Essen (DE)

(72) Inventor: Stefan König, Gudow (DE)

(73) Assignees: THYSSENKRUPP MARINE SYSTEMS GMBH, Kiel (DE); THYSSENKRUPP AG, Essen (DE)

( * ) Notice: Subject to any disclaimer, the term of this patent is extended or adjusted under 35 U.S.C. 154(b) by 96 days.

(21) Appl. No.: 16/650,982

(22) PCT Filed: Oct. 9, 2018

(86) PCT No.: PCT/EP2018/077375
§ 371 (c)(1),
(2) Date: Mar. 26, 2020

(87) PCT Pub. No.: WO2019/081194
PCT Pub. Date: May 2, 2019

(65) Prior Publication Data

US 2020/0283101 A1 Sep. 10, 2020

(30) Foreign Application Priority Data

Oct. 26, 2017 (DE) ..... 10 2017 219 251.8

(51) Int. Cl.
*B63B 27/16* (2006.01)
*B63B 27/14* (2006.01)
(Continued)

(52) U.S. Cl.
CPC ..... *B63B 27/16* (2013.01); *B63B 27/143* (2013.01); *B63B 23/30* (2013.01); *B63B 35/40* (2013.01); *B63B 2019/086* (2013.01)

(58) Field of Classification Search
CPC ..... B63B 23/00; B63B 23/30; B63B 23/32; B63B 27/145; B63B 27/143; B63B 27/16; B63B 2027/165; B63B 27/28; B63B 27/30
(Continued)

(56) References Cited

U.S. PATENT DOCUMENTS 7,581,507 B2 * 9/2009 Kern ..... B63B 27/36 114/259
8,821,066 B1 9/2014 Caccamo
(Continued)

FOREIGN PATENT DOCUMENTS

DE 102011109092 A 2/2013
KR 1020160030738 A 3/2016
(Continued)

OTHER PUBLICATIONS

English Translation of International Search Report issued in PCT/EP2018/077375, dated Dec. 19, 2018.

*Primary Examiner* — Daniel V Venne
(74) *Attorney, Agent, or Firm* — thyssenkrupp North America, LLC

(57) ABSTRACT

Apparatus and methods for recovering watercraft. A ramp is movable relative to a stationary carrying apparatus between a recovering position and a parked position. The ramp includes a frame and a deformable body, which is fastened to the frame. When the ramp is in the recovering position, the deformable body points toward the watercraft to be recovered and is located at least partially above the water surface. The watercraft travels onto the ramp and deforms the deformable body from above. The watercraft is pulled out of the water and moved onto the carrying apparatus.

25 Claims, 4 Drawing Sheets

(51) Int. Cl.
*B63B 23/30* (2006.01)
*B63B 35/40* (2006.01)
*B63B 19/08* (2006.01)

(58) Field of Classification Search
USPC ..... 114/44, 258, 259, 362, 364, 365, 366, 114/375
See application file for complete search history.

(56) References Cited

U.S. PATENT DOCUMENTS

| | | | | |
|---|---|---|---|---|
| 9,708,035 | B1 * | 7/2017 | Czepizak | B63B 21/66 |
| 9,708,037 | B2 * | 7/2017 | Ledford | B63B 23/48 |
| 2006/0191457 | A1 * | 8/2006 | Murphy | B63B 23/30 114/253 |
| 2008/0202405 | A1 | 8/2008 | Kern | |
| 2013/0025521 | A1 | 1/2013 | Soreau | |
| 2013/0291779 | A1 * | 11/2013 | Clarke | B63B 23/32 114/259 |
| 2014/0116312 | A1 | 5/2014 | Kalwa | |
| 2016/0375965 | A1 | 12/2016 | Ledford | |

FOREIGN PATENT DOCUMENTS

| | | | |
|---|---|---|---|
| TW | 201 204 599 | A | 2/2012 |
| WO | 2008098393 | A | 8/2008 |
| WO | 2016088033 | A | 6/2016 |

* cited by examiner

PICK-UP DEVICE AND PICK-UP METHOD FOR A WATERCRAFT

CROSS REFERENCE TO RELATED APPLICATIONS

This application is a U.S. National Stage Entry of International Patent Application Serial Number PCT/EP2018/077375, filed Oct. 9, 2018, which claims priority to German Patent Application No. DE 10 2017 219 251.8, filed Oct. 26, 2017, the entire contents of both of which are incorporated herein by reference.

FIELD

The present disclosure generally relates to a recovery apparatus for recovering at least one watercraft.

BACKGROUND

Often, a ship carries at least one boat while the ship is traveling on water. This boat is sometimes launched and subsequently hauled back in and recovered by the ship. One possible way of hauling the boat back on board is to use a crane on board the ship to lift the boat out of the water and set it down on board the ship. In order to save on a crane, the ship is often provided with a ramp, which is arranged only a little above the water surface. The boat travels up the ramp under its own steam or is pulled onto the ramp. Subsequently, the boat is moved into a desired position on the ramp and held there. Because the ramp slopes downward, the boat can slide quickly down the ramp and back into the water if required. Such an arrangement is used for example on board rescue cruisers.

US 2016/0 375 965 A1 discloses a recovery apparatus for watercraft (in D1: launch, recovery, and handling system, LRHS), which is installed on board a ship 14. This recovery apparatus is capable of carrying two watercraft (waterborne vessels, RHIB 201 and RHIB 202). RHIB stands for Rigid-Hull Inflatable Boat. The recovery apparatus comprises three carrying apparatuses, which are each capable of carrying a watercraft: an aft carrying apparatus (aft cradle 15), a central carrying apparatus (transfer cradle 16), and a forward carrying apparatus (forward cradle 17), as seen in the direction of travel of the ship. The aft carrying apparatus 15 can be moved into an aft zone, in which it is partially beneath the water surface (water mission zone area, WMZ area 22). The forward carrying apparatus 17 is in a stowage zone (storage area 24).

US 2008/0202405 A1 describes a mother ship (vessel or host ship 5), which is capable of optionally taking a dinghy 20 or an underwater vehicle 25 out of the water and moving it on board, cf. FIG. 1. A conveying unit (launch/recovery device 10) on board the mother ship can be pivoted selectively into a position A, in which the conveying unit 10 is partially beneath the water surface, or into a further position B, in which the conveying unit 10 is entirely under water. In position A, the conveying unit 10 is capable of recovering a dinghy 20. In position B, the conveying unit 10 is capable of recovering an underwater vehicle. A watercraft 20, 25 to be recovered travels onto the conveying unit 10. The conveying unit 10 pulls the watercraft 20, 25 out of the water and moves it onto a stationary ramp on board the mother ship 5. In one embodiment, the conveying unit 10 pulls the watercraft 20, 25 out of the water with the aid of a bar chain conveyor with "traction members" 55 and end pieces 60, cf. FIG. 2A to FIG. 2D. In the configuration of FIG. 3A and FIG. 3B, the watercraft 20, 25 travels on a V-shaped element 55 with a surface 90. This surface 90 brings about a great deal of friction between the V-shaped element 55 and the watercraft 20, 25. The V-shaped element 55 with the watercraft 20, 25 moves and pulls the watercraft 20, 25 out of the water. FIG. 5 and FIG. 6 show a guiding and propulsion unit for such V-shaped elements 55. FIG. 13 shows how two quantities of inclined bars 455 form the V-shaped elements of the ramp.

WO 2008/098393 A1 discloses a lowerable platform 1, which is fastened in an articulated manner to the stern 8 of a watercraft 10 and can be raised and lowered with the aid of a lifting mechanism 3, cf. FIG. 1. Mounted under the platform 1 is a float 2 having a hollow body 43. In the configuration according to FIG. 5, a tender receptacle 23 is mounted on the platform 1, said tender receptacle 23 being capable of carrying a tender 27. With the aid of a pair of rollers 25, the tender receptacle 23 can be moved toward the watercraft 10 in a horizontal direction relative to the platform 1. FIG. 6 shows a configuration having a plurality of modular floats 2a, which are adapted to a propulsion means, projecting into the water, of the watercraft 10.

FIG. 1 of DE 102011109092 A1 shows a system 1 that is mounted on board a ship 8 and is capable of retrieving an underwater vehicle 2. By means of a rope 50, the underwater vehicle 2 is pulled onto a retrieval ramp 12 of the system 1. A wave compensation ramp 24 is mounted on this retrieval ramp 12 in such a way that the wave compensation ramp 24 can move up and down about a horizontal pivot axis S relative to the retrieval ramp 12. The front end 26—as seen in the direction of movement of the underwater vehicle 2—of the wave compensation ramp 24 is connected to the retrieval ramp 12 via a joint 28. Mounted close to its free rear end 34 are two floating bodies 36, 38, cf. FIG. 1 and FIG. 4. The rear floating body 38 is mounted on a recovery device 40 for the underwater vehicle 2, cf. FIG. 4. The underwater vehicle 2 travels between two spread-apart guide strips 130, 132 toward the retrieval ramp 12, cf. FIG. 7, and is retained between the pushed-together guide strips 130 and 132, cf. FIG. 8.

WO 2016/088033 A1 discloses an apparatus (inflatable apparatus 1) having an inflatable fender, which can be hung on a side of the hull 21 of a boat 20 and protects the hull 21 from mechanical damage. That apparatus 1 comprises a carrying structure 2 and an inflatable bag 3, which is fastened to a segment 8 of the carrying structure 2.

It is also known to launch a boat on a slipway with a downwardly sloping ramp. A carrier, for example a trailer or boat dolly, carries the boat. The carrier can be configured as a trailer for a motor vehicle. The carrier with the boat rolls along the ramp into the water, until the boat floats on account of its buoyancy. In order to haul the boat back out of the water, the carrier is moved into the water, the boat travels onto the carrier, and the carrier with the boat is pulled up.

Thus a need exists for a recovery apparatus for recovering at least one watercraft, wherein the risk is reduced of a large quantity of water penetrating into the recovery apparatus when the ramp is in the recovering position and the watercraft travels onto the ramp.

DETAILED DESCRIPTION

Figure 1:
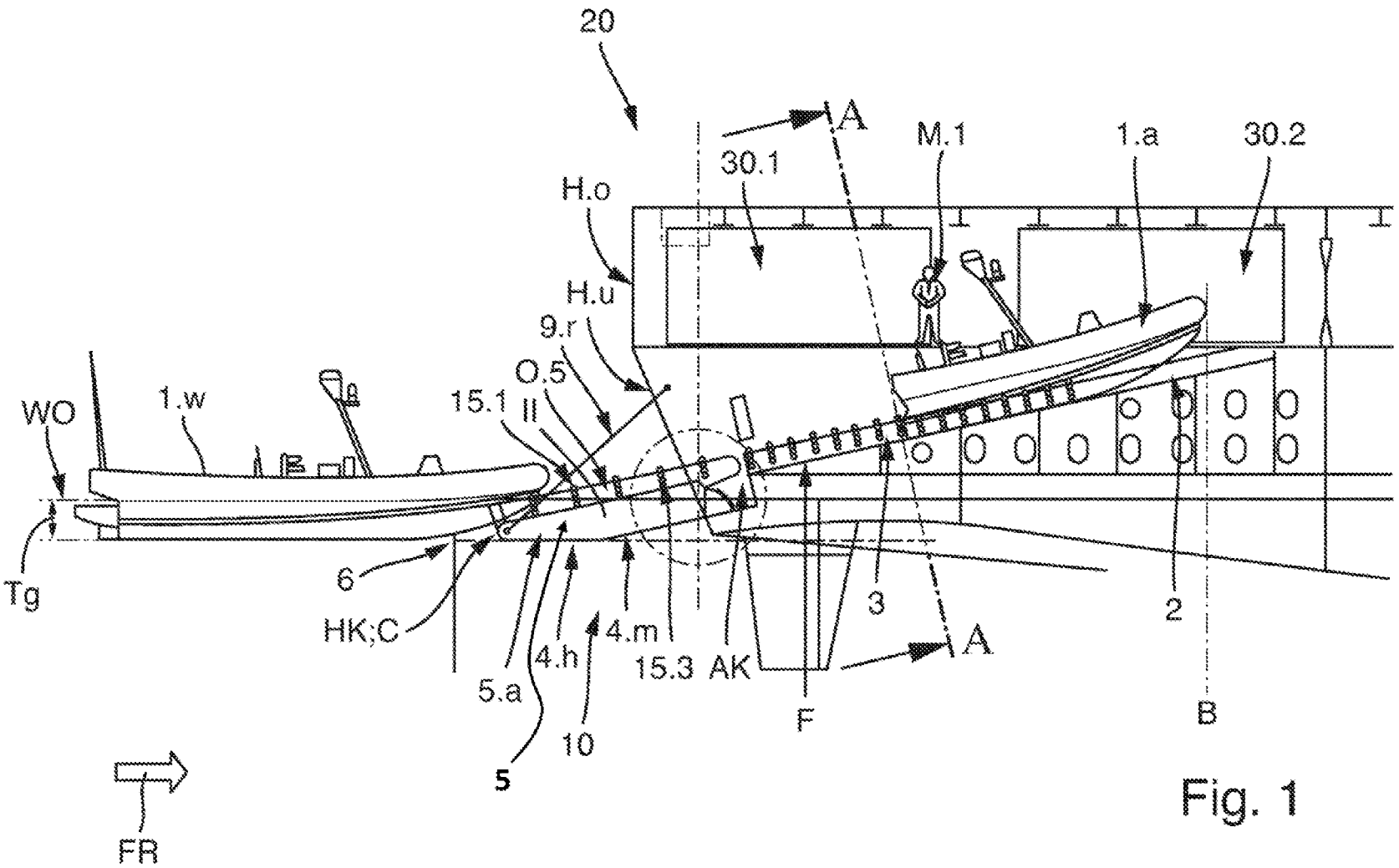
FIG. 1 is a side view of one configuration of the aft region of a mother ship, the recovery apparatus of the exemplary embodiment with the ramp in a recovering position, and a dinghy both on the water and on the carrying apparatus.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The invention relates to a recovery apparatus for recovering at least one watercraft, in particular a recovery apparatus for a boat on board a mother ship.

The recovery apparatus according to the solution is capable of recovering at least one watercraft floating on the water. It comprises a stationary carrying apparatus and a movable ramp.

The ramp can be moved relative to the stationary carrying apparatus into at least one recovering position and comprises a frame and a deformable body.

The deformable body is fastened to the frame of the ramp. If the ramp is in the or a recovering position, the deformable body points toward the watercraft located in the water. The deformable body is held at least partially above the water surface. A watercraft to be recovered travels onto the ramp and deforms the deformable body from above. The watercraft on the ramp is pulled out of the water and guided onto the stationary carrying apparatus.

The body is made of a deformable material. This means that the vertical dimension of the body is reduced under load compared with a load-free state. The body can be deformed to a greater extent than the frame of the ramp. The deformable body points toward a watercraft to be recovered when the ramp is in the or a recovering position and the watercraft is floating on the water. While the ramp is in the or a recovering position, the deformable body projects at least partially out of the water. The watercraft travels, floating on the water, toward the ramp and butts against the deformable body or butts at an acute angle against the free end of the frame and is deflected by the frame and guided against the deformable body.

In both cases, the watercraft passes onto the deformable body and deforms the deformable body from above. Because the body is deformable, the watercraft is not damaged thereby.

By virtue of the invention, the ramp does not need to be lowered in such a way that its free end is so far under water that the distance of the free end from the water surface is at least the same as the draft on the water of a watercraft to be recovered. This draft often varies and is often unknown, and so a conventional ramp often has to be lowered more than is necessary. By virtue of the deformable body, the ramp needs to be less deep in the water, i.e. with a shallower immersion depth than the draft of the watercraft. Nevertheless, the watercraft floating on the water can travel or be pulled or pushed onto the ramp and in the process deform the body and push the deformable body sufficiently far downward in order that the watercraft can travel onto the ramp and the ramp is located at least partially beneath the watercraft. Conversely, the watercraft is raised and thus its draft in the water is reduced, while it travels onto the ramp. In particular on account of this feature, less water—compared with conventional recovery apparatuses—penetrates into the recovery apparatus when the watercraft travels onto the ramp. This is advantageous in particular when the recovery apparatus belongs to a further watercraft that is floating on the water when it recovers the watercraft. A large quantity of water that has penetrated can impair the stability of the further watercraft.

It is not necessary for a lifting apparatus, for example a crane, to lift the watercraft out of the water. Because the watercraft travels onto the ramp, the watercraft can be recovered while the further watercraft is traveling and does not need to be stopped to be recovered.

Furthermore, the deformable configuration of the body makes it possible for a watercraft to be recovered to travel up to the ramp and then onto the ramp at a greater speed without there being the risk of damage to the watercraft or to the ramp, compared with a ramp that is made only from rigid material. On account of the deformation that is brought about, the deformable body absorbs kinetic energy from the traveling watercraft and brakes the travel of the watercraft without damaging the watercraft. Because—compared with a rigid ramp—the watercraft can travel onto the ramp more quickly, time is saved.

A watercraft to be recovered that travels on the water toward the ramp and then travels onto the ramp, is located at least temporarily above the deformable body and comes into contact with the deformable body. To a certain degree, the deformable body adapts automatically, by virtue of its deformability, to the underwater profile of the watercraft to be recovered. By virtue of this configuration, the same recovery apparatus is capable of successively recovering watercraft with different underwater profiles. It is not necessary for the underwater profile of the watercraft to be recovered to be precisely known or sensed. Furthermore, there is no need for an actuator that adapts the recovery apparatus to the watercraft to be recovered. The feature whereby the ramp has a deformable body therefore increases the interoperability of the recovery apparatus.

The deformable body is mounted on the frame of the ramp. This frame can be made of a rigid material and be configured so as to withstand environmental influences. It is arranged and positioned such that the deformable body is always or at least temporarily located between the frame and a watercraft to be recovered that is floating on the water, when the ramp is in the recovering position. Thus, the watercraft does not butt against the preferably rigid frame at all or only at an acute angle and in a small region, thereby reducing the risk of damage. By virtue of the frame, the ramp can be moved more easily into and out of the recovering position, even against gravity. It is not necessary to fasten an actuator or a connecting means to the deformable body itself.

In one configuration, the frame of the ramp is formed from steel or some other metal and is therefore particularly stable and robust. The deformable body does not comprise any metal constituents that come into contact with a watercraft to be recovered. This configuration reduces the risk of a watercraft to be recovered being damaged by the ramp.

According to the solution, the deformable body points toward a watercraft to be recovered when the ramp is in the or a recovering position. At least a part of the deformable body is located beneath the watercraft to be recovered. In one configuration, the watercraft slides over the deformable body onto the stationary carrying apparatus. In the process, the watercraft comes into contact with a surface of the deformable body, preferably with the upwardly facing surface.

Various configurations are possible for reducing friction between the bottom of the watercraft and the surface, facing toward the watercraft, of the deformable body. In one embodiment, this surface of the deformable body is made of a material that results in a low frictional force between the deformable body and the watercraft. In another configuration, a series of running rollers are attached to the surface of the deformable body. The watercraft slides over these running rollers and sets the running rollers in rotation. Preferably, a gap between the watercraft and the rest of the deformable body arises while the watercraft is sliding over the deformable body, such that the watercraft comes into contact only with the running rollers but not with any other constituents of the deformable body. The rest of the deformable body can therefore be made of a material having a high frictional force with the watercraft.

The deformable body can be configured as a solid body. The specific weight of the deformable solid body is preferably lower than that of water, such that the solid body can float on the water. The buoyancy that the solid body generates is greater than the weight of the ramp. The solid body can be manufactured from polystyrene or some other sufficiently light plastic.

Preferably, by contrast, the deformable body comprises at least one cavity. This cavity is surrounded by an envelope made of a deformable material. The or at least one cavity can be filled with air or with some other gas, with the result that the volume of the cavity increases and the gas in the cavity is under overpressure. This configuration makes it possible to pump the gas into the cavity or to deliver it thereto in some other way when a watercraft needs to be recovered.

The ramp with the cavity that has been pumped up or filled with gas in some other way is located in the or a recovering position and can be deformed by the watercraft when the watercraft is intended to be recovered and butts against the deformable body. The gas can be removed from the or at least one cavity again, and the cavity and thus the ramp then take up less space. As a result, the ramp can be more easily stowed or moved into a parked position in some other way when the ramp is not currently required. Compared with a ramp without a cavity, less space is required for holding the deformable body once the ramp has been moved away from the recovering position.

It is also possible for the deformable body to comprise a deformable solid body and a cavity, wherein the solid body can preferably float on the water. This configuration makes it possible for the deformable body to float on the water even when the cavity cannot be pumped up at all or cannot be pumped up fully, for example on account of a leak. It is also possible for one cavity to be filled with gas and to be emptied again and for a further cavity to be permanently filled with gas.

In one configuration, the or at least one cavity can be filled with gas in such a way that the volume of the cavity filled with gas becomes sufficiently great and the buoyancy of the deformable body is greater than its weight, preferably at least twice the weight. The deformable body can float on the water. The watercraft to be recovered butts against the floating deformable body. This configuration facilitates the desired operation whereby the watercraft pushes the deformable body downward under the water surface.

In one configuration, it is possible for not just the deformable body but also even the entire ramp to float on the water in the or a recovering position, at least as long as the watercraft to be recovered is not located on the ramp. "Floatable" means that the volume of the ramp, including the preferably rigid frame, is greater in the or a recovering position than the weight of the water displaced by the ramp. The ramp with the deformable body is located in the recovering position, floats on the water, and can be deformed by the watercraft when the watercraft is intended to be recovered and butts against the deformable body. Therefore, the ramp in the recovering position does not submerge even when it is not carried by some other constituent of the recovery apparatus. A part of the ramp projects out of the water. In particular, at least a part of the deformable body projects out of the water. The ramp is permanently in this floatable state or can be brought into this floatable state, for example by a cavity being filled with gas.

The ramp with the emptied cavity is not necessarily floatable. This is because the property of being floatable is not required when the ramp is in the or a parked position.

In another configuration, the deformable body can move up and down relative to the frame of the ramp, when the ramp is in the or a recovering position and the deformable body is floating on the water. This configuration makes it possible to move the retaining frame of the ramp in a predetermined position under water and hold it there. The deformable body floats on the water and is moved up and down relative to the frame by the water waves and by a watercraft on the ramp. This configuration simplifies the construction of an actuator for the ramp. It is enough for the actuator to move the frame into a set predetermined position under water and hold it there. Preferably, the free end of the frame is held deeply enough in the water that the distance to the water surface is greater than the draft of a watercraft to be recovered.

The configuration with the floatable body and the embodiment with the floatable ramp further reduce the risk of water penetrating into the recovery apparatus when the ramp is in the or a recovering position. The ramp is located only partially under water and partially over water and the deformable body prevents penetration. By virtue of the deformable body, the watercraft can nevertheless travel onto the ramp and push the ramp under water on account of its own weight.

In one configuration, the recovery apparatus is mounted on board a further watercraft. The ramp can move relative to the further watercraft, for example rotate or pivot in some other way, specifically preferably even when the ramp is in the or a recovering position. By virtue of the configuration in which the ramp can float on the water in the recovering position, the ramp can move relative to the further watercraft when wind or waves move the further watercraft. The upper surface of the ramp moves less relative to the water surface compared with a ramp that cannot float and is therefore carried by the further watercraft and entrained by the further watercraft.

A corresponding advantage is achieved with a floatable deformable body on the frame of the ramp, wherein the floatable body can move up and down relative to the frame. It is possible for the frame not to be moved relative to the further watercraft when the ramp is in the recovering position.

Preferably, the deformable body is transferred from another state into the floatable state. In the other state, the deformable body preferably takes up less space. This transfer is carried out preferably in a manner temporally overlapping with the step of moving the ramp from a parked position into the or a recovering position. This temporally overlapping procedure saves time. In a corresponding manner, the operation of transferring the deformable body from the floatable state into the other state is carried out in a manner temporally overlapping with the operation of moving the ramp from the recovering position into the parked position.

A watercraft to be recovered is capable of traveling or being moved in a direction of travel onto the ramp located in the recovering position. When the ramp is in the or a recovering position, the deformable body is preferably at least half as wide and half as long as the frame. The length and the width are the respective dimensions in a direction parallel to and a direction perpendicular to the direction of travel of the watercraft. Thus, the deformable body takes up at least half the width and at least half the length of the total ramp. Particularly preferably, the deformable body takes up at least three quarters of the width and three quarters of the length of the total ramp when the ramp is in the or a recovering position. Preferably, the deformable body is wider than the or each watercraft to be recovered. The configuration in which the deformable body is at least half as long and half as wide as the ramp allows the following: At least temporarily, the total watercraft is carried by the deformable body and is at a vertical distance from the frame of the ramp. The deformable body damps vibrations that emanate from the frame. Conversely, the deformable body damps vibrations that the watercraft exerts for example on account of water waves. The damping reduces wear to the watercraft to be recovered. The watercraft on the ramp cannot tip to the side by virtue of the deformable body.

Preferably, the deformable body is mounted on a carrying element that belongs to the frame of the ramp. This carrying element has a width, i.e. a dimension in a horizontal direction perpendicular to the direction of travel of a watercraft to be recovered onto the ramp, which is at least the same as the dimension of the stationary carrying apparatus in this direction. Thus, this carrying element is also wider than the watercraft to be recovered. Preferably, the carrying element is also wider than the deformable body.

It is possible to fasten at least one actuator or connecting element laterally to the carrying element, which is capable of moving the ramp, preferably in each case one element on both sides of the carrying element. By virtue of the sufficient width of the carrying element, the actuator or connecting element does not impede the travel of the watercraft onto the ramp.

If the recovery apparatus belongs to a further watercraft, the carrying element can be moved preferably into a position in which the carrying element closes off the recovery apparatus from the surrounding water. In this closed position, the carrying element completely closes off the recovery apparatus. Preferably, the carrying element in this position terminates flush with the outer hull of the further watercraft. A recovered watercraft is located in the interior of the further watercraft. This property reduces the signature of the further watercraft, i.e. the identifiability of the further watercraft in a radar image.

Preferably, the carrying element in the closed position closes off the outer hull of the further watercraft in a watertight manner. The carrying element can thus be embodied in such a stable manner and with such a thickness that it protects the recovered watercraft on the carrying apparatus and crew members to a certain degree from environmental influences, for example from water waves, wind and enemy fire.

Preferably, the ramp can be pivoted or moved linearly or moved in some other way from the recovering position into a parked position. Preferably, the ramp in the parked position is entirely above the water surface. In one configuration, the ramp can be moved between the two positions by being rotated. The axis of rotation of this rotation is located preferably above the water surface. In the or each parked position, the deformable body is located between the frame of the ramp and the stationary carrying apparatus. In this position, the deformable body prevents a watercraft on the stationary carrying apparatus from butting against the frame. This can occur in particular when the recovery apparatus belongs to a further watercraft that can travel through large waves and can thus be inclined in different directions. As a result of this inclination, the watercraft can slip along the stationary carrying apparatus onto the ramp and in one configuration is stopped by the deformable body.

Preferably, the deformable body is moved into a receiving chamber when the ramp is moved into the or a parked position. Preferably, the deformable body is moved into the receiving chamber only on account of the movement of the ramp into the parked position, for example by gravity. An additional actuator for this movement is then not necessary.

Preferably, the recovery apparatus comprises a deflector element. This deflector element is located beneath the deformable body, at least when the ramp is in the or a parked position, and raises said deformable body. As a result, the deflector element prevents a part of the deformable body from slipping undesirably downwardly and for example impeding the movement of the ramp into the parked position. The deflector element can be located in the receiving chamber.

Preferably, the ramp—or only the floatable deformable body—is fixed against shifting laterally, i.e. against undesired movement in a direction perpendicular or obliquely to the direction of travel of a watercraft onto the ramp, in the or a recovering position by at least one flexible connecting element, for example by two parallel ropes. The at least one flexible connecting element is at least temporarily tautened or tensioned when the ramp is in the or a recovering position.

It is possible for at least one running roller to tension a flexible connecting element. In another configuration, the or at least one flexible connecting element is tautened and/or tensioned by the deformable body. In this configuration, the volume of the deformable body can be increased to a maximum volume, for example in that gas under overpressure is pressed into a cavity of the deformable body. Alternatively, the dimension of the deformable body in a direction perpendicular to the direction of travel of the watercraft can be increased to a maximum dimension. When the deformable body has the maximum volume or the maximum dimension, it tensions or tautens the or at least one connecting element.

In one configuration, the recovery apparatus comprises a conveying apparatus, for example at least one conveyor belt or an endless chain, which pulls the watercraft actively out of the water. This conveying apparatus can form a constituent part of the stationary carrying apparatus or be located between the ramp and the carrying apparatus or belong to the ramp. In another configuration, the watercraft is pulled out of the water and onto the carrying apparatus with the aid of a rope. It is also possible for the watercraft to travel onto the stationary carrying apparatus by its own propulsion means. These configurations can be combined.

The watercraft to be recovered can have its own propulsion means or be pulled or pushed toward the recovery apparatus. The recovery apparatus can belong to a ship, for example to a warship, research vessel, merchant ship, passenger ship or rescue cruiser, or is a constituent of a floating platform or of a positionally fixed recovery apparatus located on land, which is positioned on a shore.

In the exemplary embodiment, the invention is implemented to recover at least one boat on board a ship. The recovering ship therefore acts as a mother ship. The or each boat is recovered for example in the interior or on the deck of the mother ship. The or each boat to be recovered has, in the exemplary embodiment, its own propulsion means, preferably a motor and at least one propeller or waterjet propulsion. The invention can also be implemented for recovering a boat or other floatable object without its own propulsion means.

Figure 4:
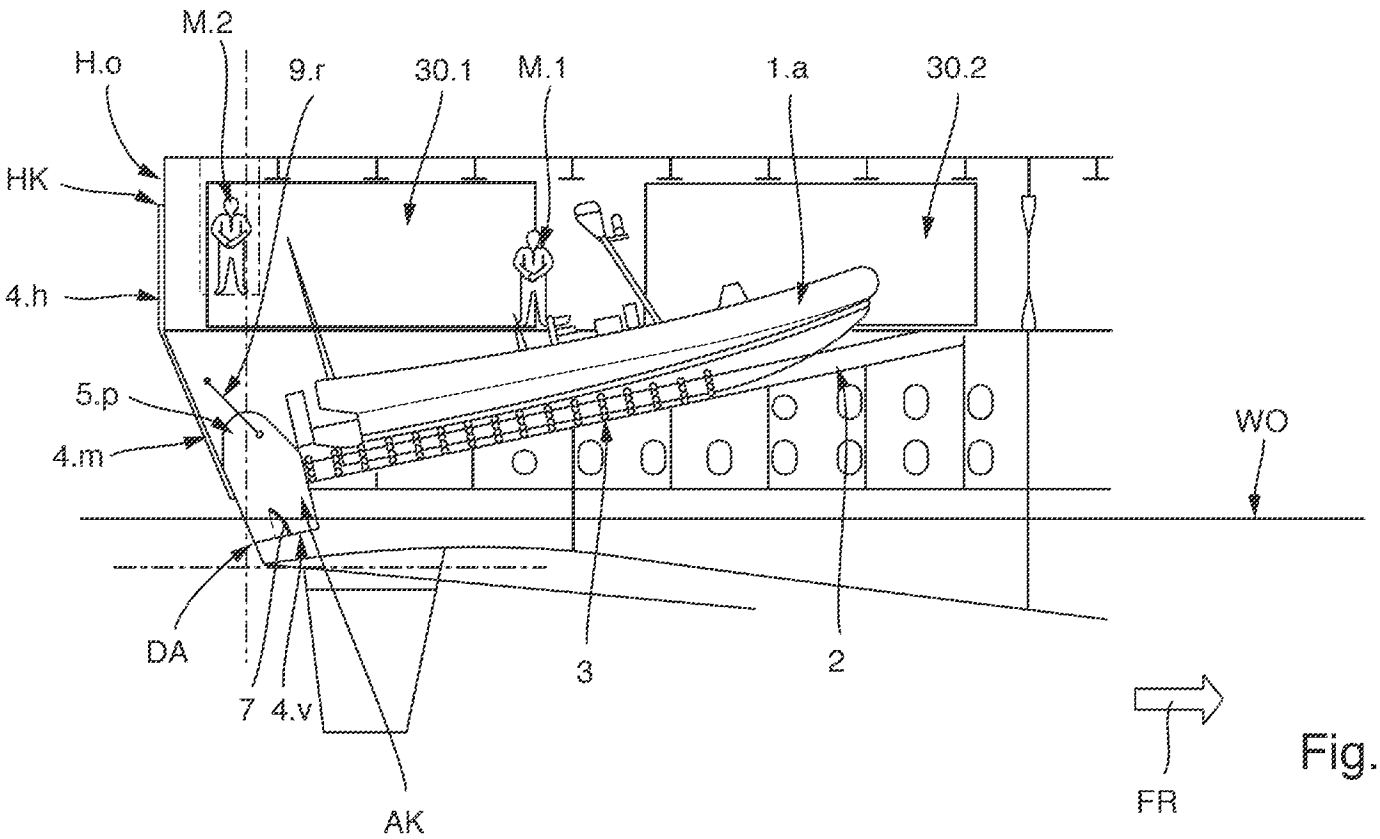
FIG. 4 is a side view of the aft region of FIG. 1 with the recovery apparatus in the parked position and the dinghy on the carrying apparatus.

FIG. 1 and FIG. 4 show, in side view from the right, the aft region of a recovering watercraft 20, which is also referred to as mother ship and has a carrying structure T. A lower part H.u and an upper part H.o of the stern of the mother ship 20 are shown. FIG. 1 furthermore shows the same dinghy 1, in one case floating on the water surface WO (position 1.*w*) and in the other case recovered on the mother ship 20 (position 1.*a*). The recovered dinghy 1 in position 1.*a* rests on a stationary carrying apparatus 2, which belongs to a boat garage of the mother ship 20 and the upper surface of which, as seen in the direction of travel of the mother ship 20, rises obliquely, cf. FIG. 1 and FIG. 4.

In the exemplary embodiment, the dinghy 1 is driven by waterjet propulsion. It is also possible for the dinghy 1 to have at least one outboard motor. The latter is swung upward before the propeller reaches the recovery apparatus according to the solution. The dinghy 1 to be recovered can also be configured without its own propulsion means.

A crew member M.1 of the dinghy 1 or of the mother ship 20 can leave the boat garage through a door (not shown) and re-enter the boat garage later in the same way. In FIG. 1 and FIG. 4 two containers 30.1 and 30.2 are furthermore shown on board the mother ship 20, these not belonging to the recovery apparatus of the exemplary embodiment.

Figure 2:
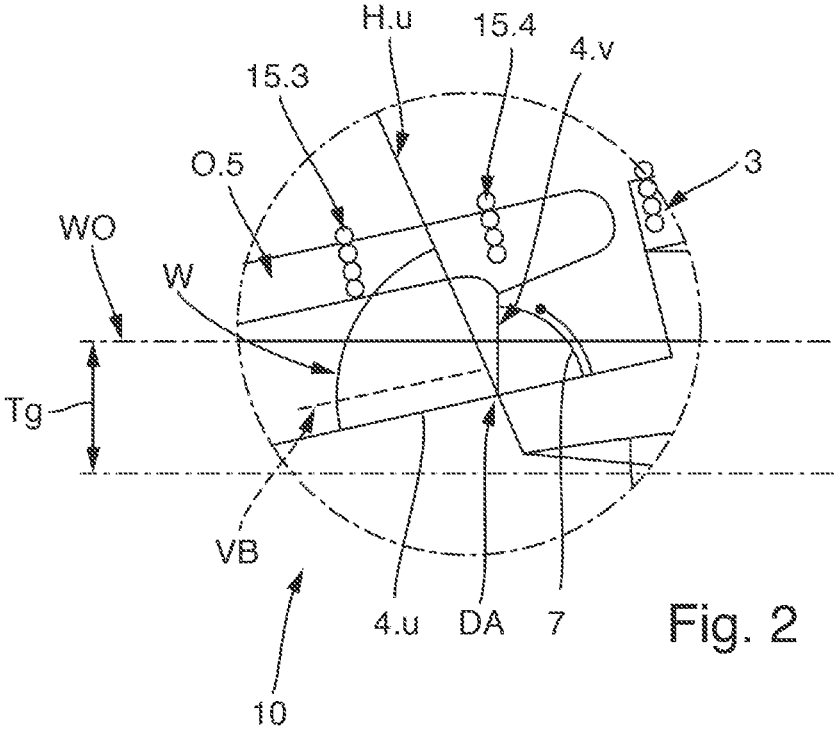
FIG. 2 is an enlarged view of the region II in FIG. 1.
Figure 3:
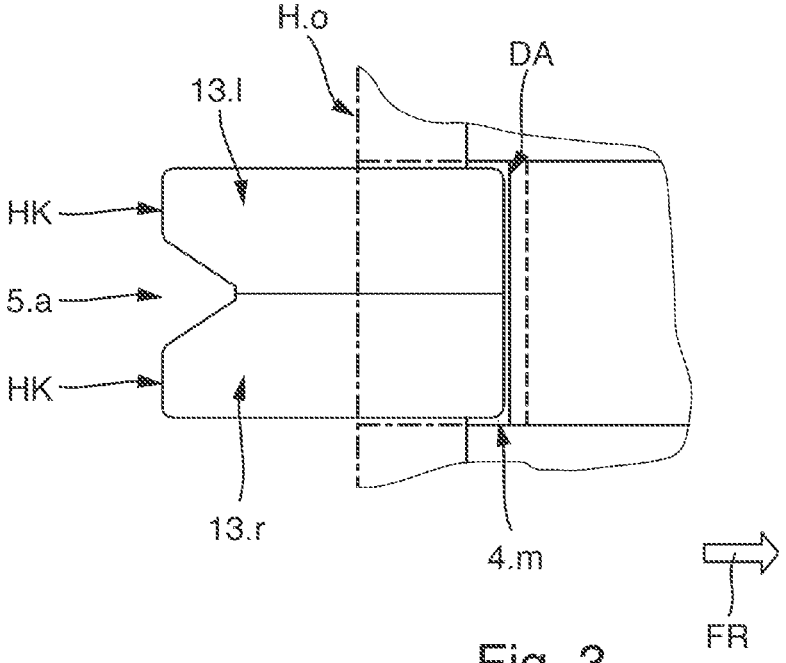
FIG. 3 is a plan view of part of the arrangement in FIG. 1.

FIG. 2 shows an enlarged illustration of the region II in FIG. 1, i.e. the front part of the ramp 10 and the rear part of the carrying apparatus 2. FIG. 3 shows a plan view of a part of the arrangement in FIG. 1.

In the following, the terms "front", "rear", "right" and "left" relate to the corresponding directions of travel FR of the dinghy 1 and of the mother ship 20. In FIG. 1 to FIG. 4, the direction of travel FR is from right to left, and in FIG. 5 it is away from the observer.

Figure 5:
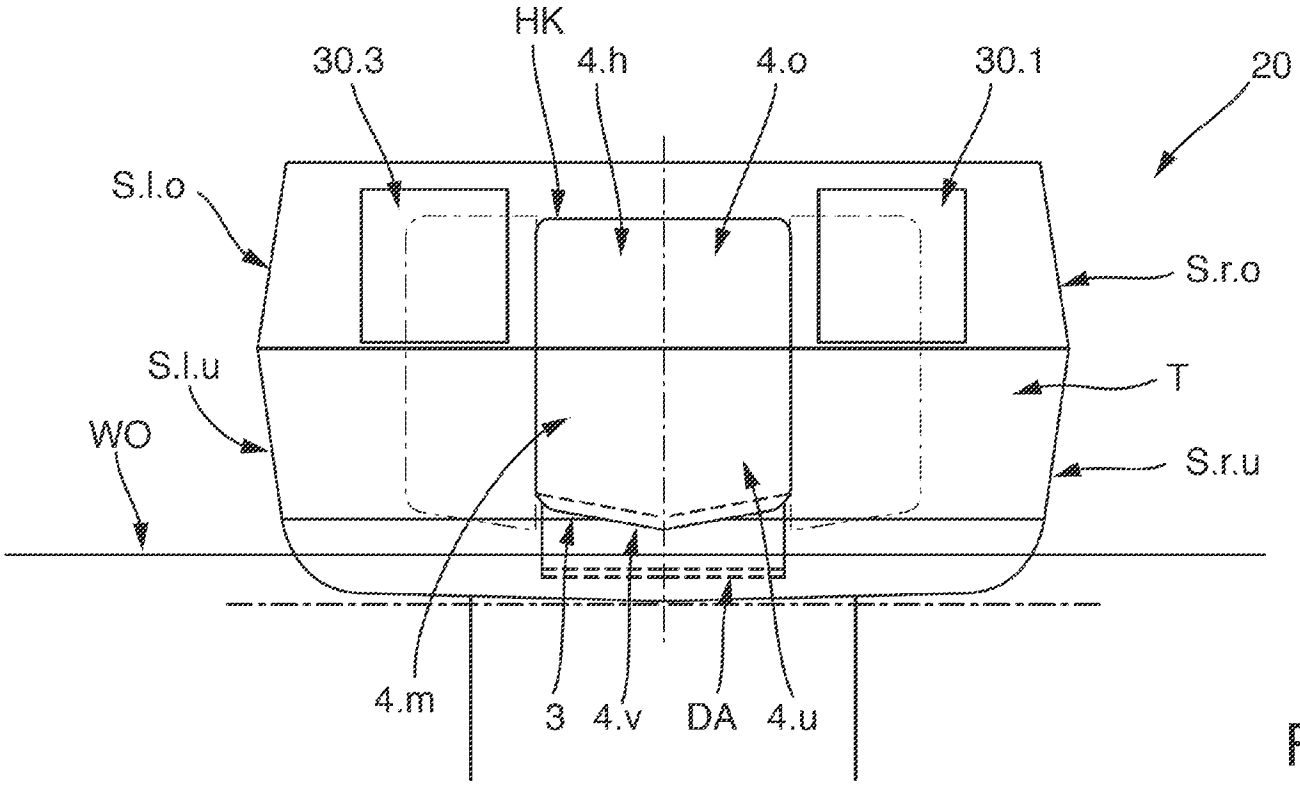
FIG. 5 is a rear view of the aft region in FIG. 4.

The dinghy 1 to be recovered that is in the position 1.*w* travels from the rear toward the mother ship 20 and reaches a ramp 10, which can be moved about a horizontal axis of rotation DA relative to the carrying apparatus 2 and to the carrying structure T of the mother ship 20 between two positions, namely between at least one recovering position (FIG. 1 to FIG. 3) and a parked position (FIG. 4 and FIG. 5). The horizontal axis of rotation DA is perpendicular to the direction of travel FR and is located preferably above the water surface WO. The dinghy 1 in the position 1.*w* has a draft Tg and reaches the ramp 10 in a contact position C, cf. FIG. 1.

In one configuration, the dinghy 1 in the position 1.*w* is caught from below by a conveying apparatus 6 of the ramp 10 and pulled onto the obliquely rising ramp 10. The conveying apparatus 6 can comprise a conveyor belt or a chain. The dinghy 1 is then pushed onward with the aid of a further conveying apparatus 3, which belongs to the stationary carrying apparatus 2. The separate propulsion means of the dinghy 1 supports this movement onto the ramp 10 and subsequently on the carrying apparatus 2, until the separate propulsion means has been lifted entirely out of the water at the point F. The two conveying apparatuses 3 and 6 form, in the exemplary embodiment, a continuous oblique plane. As soon as the bow of the dinghy 1 reaches the point F, the or each propeller or the waterjet propulsion of the dinghy 1 is pulled completely out of the water, and the dinghy 1 is now moved only by the conveying apparatuses 3 and 6. The dinghy 1 has reached the parked position 1.*a* in the boat garage when the stern of the dinghy 1 has passed a predetermined point, for example the plane A-A, or the bow has reached the point B. In one embodiment, a sensor (not shown) automatically detects one of these two events. As soon as one of these two events has occurred, the two conveying apparatuses 3 and 6 are stopped.

In a modification, the ramp 10 does not have a separate conveying apparatus 6, but rather a nondriven running belt, which forms a continuous oblique plane with the conveying apparatus 3. On account of its separate propulsion means, the dinghy 1 moves this running belt as soon as it has reached the point C. The separate propulsion means pushes the dinghy 1 as far as the point F. Preferably, the dinghy 1 can move the running belt only such that the dinghy 1 is moved toward the mother ship 20. The running belt prevents the dinghy 1 from slipping back into the water again. The driven conveying apparatus 3 of the carrying apparatus 2 operates in the same way as was just described above.

In a third configuration, the ramp 10 does not have a conveying device 6 or a running belt. In this configuration, too, the upper surfaces of the ramp 10 and of the conveying apparatus 3 form a continuous oblique plane. The dinghy 1 in the position 1.*w* slides directly on the deformable body 5, which forms the upper surface O.5 of the ramp 10 and is described further below, toward the carrying apparatus 2.

In one configuration, a multiplicity of rollers 15.1, 15.2, . . . on the upper surface of the deformable body 5 point upward. The dinghy 1 slides over these rollers 15.1, 15.2, . . . . The rollers 15.1, 15.2, . . . reduce the friction between the deformable body 5 and the dinghy 1. These rollers 15.1, 15.2, . . . can be nondriven running rollers or driven rolls.

It is also possible for neither the ramp 10 nor the carrying apparatus 2 to have a separate conveying apparatus. The dinghy 1 slides over the upper surface O.5 of the ramp 10 and over the upper surface of the carrying apparatus 2 into the position 1.*a*. In this configuration, too, the upper surfaces form a continuous oblique plane. Running rollers can be attached to the upper surface O.5 of the deformable body 5 and/or of the stationary carrying apparatus 2. The dinghy is pushed by the separate propulsion means to the carrying apparatus 2. In one configuration, the dinghy 1 is additionally pulled onto the carrying apparatus 2 by a rope (not shown).

The ramp 10 of the exemplary embodiment has the following constituents:

a rigid frame, a deformable body 5, and, in one configuration, the conveying apparatus 6 or the running belt, which is guided around the deformable body 5.

The surface O5, pointing toward the dinghy 1, of the ramp 10 and the upper surface of the carrying apparatus 2, for example the conveying apparatus 3, are—as seen in a viewing direction parallel to the direction of travel FR—formed in a V-shaped manner or bilge-shaped in some other way. As a result, they match the underwater profile of the dinghy 1.

The frame of the ramp 10 comprises a sufficiently thick bearing plate 4 with a rear part 4.*h*, a central part 4.*m*, and a front part 4.*v*, two preferably flexible connecting elements 9.*l*, 9.*r*, and two actuators (not shown), which are connected to the bearing plate 4 in an articulated manner.

Each plate part 4.*v*, 4.*m*, 4.*h* extends in a respective plane. The front plate part 4.*v* is connected firmly to the central plate part 4.*m* for example at an angle of about 100 degrees in an edge that is perpendicular to the direction of travel FR. The central plate part 4.*m* is firmly connected to the rear plate part 4.*h*, in the exemplary embodiment, at an angle of about 160 degrees in a parallel edge. Other configurations of the bearing plate 4 are likewise possible.

The bearing plate 4 can be rotated about a horizontal axis of rotation DA relative to the carrying structure T of the mother ship 20 and thus to the carrying apparatus 2, said axis of rotation DA being perpendicular to the drawing planes of FIG. 1, FIG. 2 and FIG. 4 and lying in the drawing planes of FIG. 3 and FIG. 5 and being arranged above the water surface. The bearing plate 4 can be rotated back and forth through an angle W (FIG. 2) between a recovering position (FIG. 1) and a parked position (FIG. 4). At least one stop element (not shown) limits the rotation of the bearing plate 4 downwardly from the parked position into the recovering position. The carrying structure T of the mother ship 2 limits the movement of the ramp 10 upward in the opposite direction. When the ramp 10 is in the recovering position, the central plate part 4.*m* and the rear plate part 4.*h* are located entirely under the water surface WO, cf. FIG. 1. Of course, on account of movements executed by the mother ship 20 and on account of waves, the bearing plate 4 can sometimes and partially emerge from the water.

In the parked position, the rear plate part 4.*h* terminates flush with the upper stern part H.o and the central plate part 4.*m* terminates flush with the lower stern part 4.*u*. The angle between the plate parts 4.*h* and 4.*m* matches the angle between the stern parts 4.*o* and 4.*u*, cf. FIG. 4. When the ramp 1 is in the parked position, the deformable body 5 is in the interior of the mother ship 20. As a result, the mother ship 20 with the ramp 10 in the parked position has a smaller electronic signature.

The two actuators, which are configured for example as two hydraulic or pneumatic piston-cylinder units and are not shown, are connected to the bearing plate 4 at two lateral fastening points, are supported on the carrying structure T of the mother ship 20, and can rotate the ramp 10 back and forth about the axis of rotation DA between the two positions.

A flexible right-hand connecting element 9.*r* and a corresponding flexible left-hand connecting element 9.*l* (not shown) are connected to the bearing plate 4 and to the carrying structure T of the mother ship 20 at two lateral fastening points, cf. FIG. 1 and FIG. 4. When the ramp 10 is in the recovering position and therefore fully lowered, the connecting elements 9.*l*, 9.*r* are fully tensioned.

The upper surface O.5 of the deformable body 5 is exposed to greater wear than the rest of the deformable body 5 because a dinghy 1 repeatedly butts against this upper surface O.5 and is deflected. The following configuration avoids the necessity to replace the entire deformable body 5 in the event of wear. In this configuration, the upper surface O.5, pointing toward the dinghy 1, of the deformable body 5 is provided with a stable protective cover. The running rollers 15.1, 15.2, . . . may have been let into this protective cover or project upward through cutouts in the protective cover. This stable protective cover is connected releasably to the rest of the deformable body 5. Preferably, this stable protective cover can deform together with the rest of the deformable body 5. In this configuration, the dinghy 1 to be recovered comes into contact with the stable and preferably deformable protective cover and, in one configuration, additionally with the running rollers, but not with any other constituent of the deformable body. The protective cover wears down more than the rest of the deformable body 5. In the event of wear, only the stable protective cover needs to be replaced.

The deformable body 5 can be formed as a solid body made of a deformable material, for example rubber.

In the exemplary embodiment, the deformable body 5 comprises at least one cavity, which can be filled with a gas and is subdivided preferably into two chambers 13.*l*, 13.*r*, cf. FIG. 4. In the following, the term "hollow body 5" is used where reference is made to the property of the deformable body 5 of the exemplary embodiment comprising a cavity that can be filled with a gas.

As is indicated in FIG. 4, the two chambers 13.*l*, 13.*r* of the cavity 5 have two upper surfaces that point obliquely upward. These surfaces together form an obliquely rising face having—as seen in the direction of travel FR—a V-shaped cross section. The rear ends of the two chambers 13.*l*, 13.*r* together have, in the exemplary embodiment, as seen from above, a dovetail shape, which matches the underwater profile of the front segment of the dinghy 1 to be recovered.

In one configuration, a delivery unit (not shown), for example a hydraulic or pneumatic pump, is capable of delivering a gas into the cavity 13.*l*, 13.*r* and as a result of generating an overpressure in this cavity 13.*l*, 13.*r*. In another configuration, a fluidic connection is established between the cavity 13.*l*, 13.*r* and at least one source for gas under overpressure, for example a compressed air cylinder, and the cavity 13.*l*, 13.*r* is filled in this way.

The envelope of the cavity 13.*l*, 13.*r* forms the outer surface of the deformable body 5 and is produced from a deformable material, for example of rubber. When the cavity 13.*l*, 13.*r* is filled with gas, the hollow body 5 expands to the rear, top, left and right, and the volume of the deformable hollow body 5 can be enlarged to a maximum volume. The deformable body 5 is then in a fully inflated state 5.*a*, cf. FIG. 1, FIG. 2 and FIG. 3. When the gas is let out through an opening in the envelope again, the volume of the deformable hollow body 5 is reduced again. The deformable body 5 is then in an emptied state 5.*p*, cf. FIG. 4 and FIG. 5.

The deformable body 5 is fastened to the bearing plate 4. When the ramp 10 is in the recovering position, the deformable body 5 is located above the bearing plate 4. In one configuration, the rear edge HK of the bearing plate 4 projects toward the rear beyond the deformable body, for example the hollow body 5 in the inflated state 5.*a*, cf. FIG. 1. In another configuration, the deformable body 5 projects beyond the rear edge HK.

In the exemplary embodiment, the hollow body 5 in the inflated state 5.*a*. is capable of floating on the water. In one embodiment, the hollow body 5 in the inflated state 5.*a* is even capable of carrying the ramp 10 on the water. The buoyancy created by the inflated hollow body 5 is in this case greater than the weight of the ramp 10.

In one configuration, the deformable body 5 is fastened to the bearing plate 4 along the entire length of the bearing plate 4 or at least along the entire length of the central plate part 4.*m* and the front plate part 4.*v*. As a result, the deformable body 5 remains connected extensively to the bearing plate 4 even when the ramp 10 is in the recovering position. In another configuration, the deformable body 5 is fastened only to a front region of the central plate part 4.*m* and preferably to the front plate part 4.*v* or even only to the front plate part 4.*v*. The rear plate part 5.*h* is not connected to the deformable body 5. FIG. 2 shows for example a connecting region VB in which the deformable body 5 configured as a hollow body is fastened to the central plate part 4.*m*.

As mentioned above, the hollow body 5 in the inflated state 5.*a* or the deformable body 5 configured as a solid body is capable preferably of floating on the water. A number of configurations of the ramp 10 in the recovering position with the preferably floatable deformable body 5 are possible:

In one configuration, the deformable body 5 is connected to the bearing plate 4 only in a front region, for example in the connecting region VB. When the ramp 10 has reached the recovering position and the frame parts 4.*m*, 4.*h* are located under water, the inherent buoyancy lifts the deformable body 5 off the bearing plate 4 for example away from the connecting region VB. The deformable body 5 can move up and down relative to the bearing plate 4, preferably about a horizontal axis parallel to the axis of rotation DA, for example on account of waves or because the boat 1 is traveling toward the ramp 10. In one configuration, the flexible connecting elements 9.*l*, 9.*r* damp the movements of the floating hollow body 5, because the inflated hollow body 5 tensions the flexible connecting elements 9.*l*, 9.*r*, or even prevent such movements of the hollow body 5. The bearing plate 4 can be held in a fixed position beneath the floating deformable body 5 at the water surface WO and preferably does not execute any movements relative to the mother ship 20.

In an alternative configuration, the deformable body 5 carries the entire ramp 10, i.e. including the bearing plate 4, on the water. The deformable body 5 can be connected to the bearing plate 4 along a substantial part of its length. The bearing plate 4 can rotate about the axis of rotation DA relative to the mother ship 20, while the ramp 10 floats on the water. As a result, the entire ramp 10 can move up and down relative to the mother ship 20 for example on account of waves or because the boat 1 is traveling toward the ramp 10.

In a third configuration, a support apparatus, for example two lateral spring elements or two lateral piston-cylinder units, holds the ramp 10 in the recovering position, such that the deformable body 5 remains partially over the water surface WO. The buoyancy of the deformable body 5 and the support apparatus compensate for the weight of the ramp 10. Preferably, the ramp 10 can move up and down relative to the mother ship 20. The actuator for the ramp 10 continuously compensates for the movement of the mother ship 20, while the ramp 10 is in the recovering position, such that the deformable body 5 always projects out of the water by approximately the same amount.

As already mentioned, two flexible lateral connecting elements 9.*l*, 9.*r* hold the ramp 10 in a desired centered position, in which the upper surface O.5 of the ramp 10 and the upper surface of the stationary carrying apparatus 2 form a continuous rising oblique plane. The deformable body 5 is located between the connecting elements 9.*l* and 9.*r*. In a preferred configuration, the inflated hollow body 5 tensions the connecting elements 9.*l*, 9.*r*. This configuration allows particularly good fixing of the lowered ramp 10 in the centered position. When the hollow body 5 has been emptied (state 5.*p*), the connecting elements 9.*l*, 9.*r* are slack or partially retracted into the carrying structure and do not impede any movement of the ramp 10.

The ramp 10 is fastened in a rotatable manner to the carrying structure T of the mother ship 20. When the ramp 10 is in the recovering position, the bottom of a receiving chamber AK and the central plate part 4.*m* form preferably a continuous oblique plane. This bottom and a front wall of the receiving chamber AK are not moved together with the ramp 10 and enclose the receiving chamber AK. When the ramp 10 is raised into the parked position, the emptied and slack hollow body 5 slides into this receiving chamber AK. The central plate part 4.*m* forms the rear wall of the receiving chamber AK when the ramp 10 is in the parked position. The deflector plate 7 is fastened to the bottom of the receiving chamber AK and projects into the receiving chamber AK. The receiving chamber AK is smaller than the hollow body 5 in the inflated state 5.*a*.

FIG. 4 and FIG. 5 show the ramp 10 in the raised parked position and the hollow body 5 in the emptied position 5.*p*. The now slack hollow body 5 is located in the receiving chamber AK and above the deflector plate 7. This deflector plate 7 prevents the now slack hollow body 5 from slipping downward and passing for example between the bearing plate 4 and the carrying structure T. The connecting elements 9.*l*, 9.*r* are slack or partially retracted into the carrying structure T.

In the exemplary embodiment, the dinghy 1 is moved from the position 1.*w* onto the carrying apparatus 2 as follows:

The ramp 10 is moved out of the parked position (FIG. 4) into the recovering position (FIG. 1), for example in that two hydraulic piston-cylinder units are extended, these being supported on the carrying structure T of the mother ship 20 and being connected to the bearing plate 4. The bearing plate 4 is as a result rotated about the axis of rotation DA until the piston-cylinder units have been fully extended or until the or each stop element ends the further rotation of the bearing plate 4. The deformable body 5 is rotated with the bearing plate 4 about the axis of rotation DA.

In one configuration, the hollow body 5 is inflated in a manner temporally overlapping with the lowering of the ramp 10, and as a result is transferred from the emptied state 5.*p* (FIG. 4) into the inflated state 5.*a* (FIG. 1).

At the latest when the ramp 10 has reached the recovering position, the deformable body 5 floats on the water. In one embodiment, on account of its buoyancy, the inflated hollow body 5 or floatable hollow body 5 detaches from the bearing plate 4, which is located under water, in the regions in which it is not connected to the bearing plate 4. The actuator holds the bearing plate 4 in a fixed position relative to the mother ship 20, wherein the plate parts 4.*m* and 4.*h* remain under water. In another embodiment, the entire ramp 10 floats on account of its inherent buoyancy on the water. In a third embodiment, the support apparatus holds the ramp 10 in a position in which the deformable body 5 projects out of the water. In the two latter embodiments, the entire ramp 10 moves up and down relative to the mother ship 20 when water waves move the mother ship 20 or the ramp 10.

The inflated hollow body 5 is located between the connecting elements 9.*l* and 9.*r*. The connecting elements 9.*l*, 9.*r* are slack or tensioned and hold the ramp 10 and in particular the deformable body 5 in the centered position.

The dinghy in the position 1.*w* travels from the rear onto the ramp 10 and touches the ramp 10 at the contact point C. In one configuration, the contact point C coincides with the rear edge HK of the bearing plate 4, cf. FIG. 1. In another configuration, the contact point C is formed by the rear termination of the inflated hollow body 5 floating on the water.

The separate propulsion means pushes the dinghy 1 onto the ramp 10. Depending on the configuration of the dinghy 1 and of the ramp 10, the dinghy 1 touches either the rear plate part 4.*h* first or the rear termination of the deformable body 5. As mentioned above and visible in FIG. 3, the rear termination of the inflated hollow body 5 has preferably a dovetail shape and matches the underwater profile of the dinghy 1.

In both cases, the dinghy 1 pushes the deformable body 5 downward and under water, while the dinghy 1 travels toward the mother ship 20. The feature whereby the body 5, which is preferably configured as an inflated hollow body 5, is deformable prevents any damage to the dinghy 1. Conversely, the oblique surface O.5 of the ramp 10 lifts the dinghy 1 out of the water. The V-shaped or otherwise bilge-shaped configuration of the upper surface O.5, i.e. of the conveying apparatus 6 or of the running belt or of the deformable body 5, contributes toward lifting the dinghy 1 gently out of the water onto the ramp 10.

The conveying apparatus 3 of the carrying apparatus 2 pulls the dinghy 1 further out of the water, until the dinghy has reached the parked position 1.*p* on the carrying apparatus 2, cf. FIG. 4. The drive of the conveying apparatus 3 is now stopped. Alternatively, the dinghy 1 is connected on one side to a rope, and the rope with the dinghy 1 is pulled by a winch.

The actuator rotates the bearing plate 4 about the axis of rotation DA back upward into the parked position (cf. FIG. 4 and FIG. 5), for example in that the piston-cylinder units are retracted again. The plate parts 4.*m* and 4.*h* now terminate flush with the outer hull of the mother ship 20. In a manner temporally overlapping with this rotation, the gas is let out of the hollow body 5. When the bearing plate 4 has reached the parked position, the front plate part 4.*v* lies on the bottom of the receiving chamber AK and the hollow body 5 is slack, i.e. in the state 5.*p*. The now slack hollow body 5 drops into the receiving chamber AK and onto the deflector plate 7.

In a corresponding manner, the dinghy 1 can be moved back out of the position 1.*a* on the carrying apparatus 2 into the position 1.*w* on the water. On account of its inherent weight, the dinghy 1 slides downward into the water via the oblique plane.

REFERENCE SIGNS

1 Dinghy to be recovered, acts as the watercraft to be recovered

1.*a* Position of the recovered dinghy 1 when it rests on the stationary carrying apparatus 2

1.*w* Position of the dinghy 1 to be recovered when it floats on the water

2 Stationary and obliquely rising carrying apparatus, carries the recovered dinghy 1.*a*, comprises in one configuration the conveying apparatus 3

3 Optional conveying apparatus of the stationary carrying apparatus 2, pulls the dinghy 1.*w* to be recovered out of the water

4 Bearing plate, on which the hollow body 5 is mounted, is fastened to the carrying structure T in the axis of rotation DA, comprises the plate parts 4.*h*, 4.*m* and 4.*v*, belongs to the frame of the ramp 10, acts as planar carrying element

4.*h* Rear part of the bearing plate 4, has the rear edge HK

4.*m* Central part of the bearing plate 4

4.*v* Front part of the bearing plate 4

5 Deformable body, preferably configured as inflatable hollow body, which is subdivided into the chambers 13.*l* and 13.*r*

5.*a* Inflated state of the hollow body 5, in which the hollow body 5 can float on the water

5.*p* Emptied state of the hollow body 5, in which the now slack hollow body 5 can be received in the receiving chamber AK

6 Optional conveying apparatus of the ramp 10

7 Deflector plate in the receiving chamber AK, prevents the emptied hollow body 5 in the state 5.*p* from slipping under the bearing plate 4

9.*l* Flexible left-hand connecting element in the form of a rope

9.*r* Flexible right-hand connecting element in the form of a rope

10 Ramp, comprises the bearing plate 4 and the connecting elements 9.*l*, 9.*r*, and the deformable body 5

10.*p* Ramp 10 in the parked position, in which the bearing plate 4 terminates flush with the outer hull of the mother ship 20

10.*w* Ramp 10 in the recovering position, in which the deformable body 5 projects out of the water, preferably floats on the water

13.*l*, 13.*r* Left-hand and right-hand chamber of the hollow body 5

15.1, 15.2 Running rollers, let into the upper surface O.5 of the deformable body 5

20 Mother ship, recovers the dinghy 1.*w* on the carrying apparatus 2, comprises the recovery apparatus, the carrying structure T, the stern H.u, H.o and the side walls S.l.o, S.l.u, S.r.o, S.r.u

30.1, 30.2, 30.3 Containers on board the mother ship 20

AK Receiving chamber for the emptied hollow body 5 (in the state 5.*p*)

C Point of first contact, at which the dinghy 1.*w* first touches the ramp 10

DA Horizontal axis of rotation, about which the ramp can be rotated relative to the carrying structure T of the mother ship 20 and relative to the carrying apparatus 2

F Point at which the propulsion means of the dinghy 1 is pulled out of the water and can no longer propel the dinghy 1

FR Corresponding direction of travel of the dinghy 1 and of the mother ship 20

HK Rear edge of the bearing plate 4, forms an edge of the rear part 4.*h*

H.o Upper part of the stern of the mother ship 20, terminates flush with rear plate part 4.*h* when the ramp 10 is in the parked position H.u Lower part of the stern of the mother ship 20, terminates flush with the central plate part 4.*m* when the ramp 10 is in the parked position O.5 Upper surface of the deformable body 5, comes into contact with the dinghy 1, is provided with the running rollers 15.1, 15.2, . . . in one configuration S.l.o Upper part of the left-hand side wall of the mother ship 20

S.l.u Lower part of the left-hand side wall of the mother ship 20

S.r.o Upper part of the right-hand side wall of the mother ship 20

S.r.u Lower part of the right-hand side wall of the mother ship 20

M.1, M.2 Crew member of the watercraft 1

T Carrying structure of the mother ship 20, carries the ramp 10 and the carrying apparatus 2

Tg Draft of the dinghy 1 in the position 1.*w* on the water

VB Connecting region, in which the deformable body 5 is connected to the central plate part 4.*m* of the bearing plate 4

W Angle between the recovering position and the parked position of the ramp 10

WO Water surface

What is claimed is:

1. A recovery apparatus for recovering from water a watercraft, the recovery apparatus comprising:

a stationary carrying apparatus sized and shaped to carry a watercraft; and a ramp that is configured to move relative to the stationary carrying apparatus;

wherein the ramp is configured to move into a recovering position, in which the ramp is located at least partially beneath a surface of the water and is configured such that the watercraft can travel onto the ramp;

wherein the recovery apparatus is configured to lift the watercraft out of the water and guide it onto the carrying apparatus;

wherein the ramp includes a frame; and a deformable body fastened to the frame such that the deformable body points toward the watercraft located in the water when the ramp is in the recovering position, wherein the deformable body comprises a gas-fillable cavity, wherein the cavity is surrounded by an envelope made of a deformable material, and wherein the recovery apparatus is configured to hold the deformable body at least partially above the surface of the water when the ramp is in the recovering position.

2. The recovery apparatus of claim 1 wherein the recovery apparatus comprises a delivery device configured to deliver gas under pressure into the cavity.

3. The recovery apparatus of claim 1 wherein the cavity is configured to be enlarged to a maximum volume by being filled with gas, and, at least when the cavity has reached the maximum volume, the deformable body is capable of floating on the water.

4. The recovery apparatus of claim 1 wherein the deformable body comprises a deformable solid body manufactured from a material that has a lower specific weight than water.

5. The recovery apparatus of claim 1 wherein the recovery apparatus comprises a support apparatus configured to carry the ramp located in the recovering position such that the deformable body is located at least partially above the water surface.

6. The recovery apparatus of claim 1 wherein the deformable body is connected to the frame in a connecting region, wherein the extension of the connecting region in the direction of travel of a watercraft to be recovered is less than the extension of the frame in the direction of travel, and the deformable body is capable of floating on the water at all times or in at least one state, wherein, when the ramp is in the recovering position, the deformable body floats on the water, the frame of the ramp is at least temporarily entirely under the water surface, and, outside the connecting region, a vertical gap arises between the floating deformable body and the frame.

7. The recovery apparatus of claim 1 wherein the ramp is connected to the stationary carrying apparatus in a movable manner such that a watercraft on the ramp located in the recovering position is capable of pushing the ramp down relative to the carrying apparatus.

8. The recovery apparatus of claim 1 the deformable body, both parallel and transversely to the direction of travel of the watercraft onto the ramp, takes up in each case at least half of the ramp located in the recovering position.

9. The recovery apparatus of claim 1 wherein the frame of the ramp has a carrying element, wherein the deformable body is fastened to the carrying element and wherein the carrying element has a dimension in a direction perpendicular to the direction of travel of a watercraft onto the ramp that is at least as large as the dimension of the stationary carrying apparatus in this direction.

10. The recovery apparatus of claim 1 wherein the ramp is configured such that a surface of the deformable body points toward the watercraft to be recovered located in the water, and comes at least temporarily into contact with the watercraft when the ramp is in the recovering position, wherein at least one running roller is mounted on the surface.

11. The recovery apparatus of claim 1 wherein the deformable body has a coating element connected releasably to the deformable body and, when the ramp is in the recovering position, points toward a watercraft to be recovered located in the water.

12. The recovery apparatus of claim 1 wherein the ramp is movable out of the recovering position into a parked position, wherein, when the ramp is in the parked position, the deformable body is located between the frame of the ramp and the stationary carrying apparatus.

13. The recovery apparatus of claim 1 wherein the ramp is movable out of the recovering position into a parked position, and the recovery apparatus has a receiving chamber, which, when the ramp is in the parked position, is configured to receive the deformable body.

14. The recovery apparatus of claim 13 wherein the frame of the ramp comprises at least one planar component, which extends in a plane, wherein, when the ramp is in the parked position, the plane of the planar component encloses an angle of at most twenty degrees with the vertical.

15. The recovery apparatus of claim 13 wherein the recovery apparatus comprises a deflector element, which, when the ramp is in the parked position, is located beneath the deformable body.

16. The recovery apparatus of claim 1 wherein the deformable body is permanently in a state or is configured to be brought into a state in which the buoyancy of the deformable body causes the ramp located in the recovering position to float on the water.

17. The recovery apparatus of claim 1 wherein the recovery apparatus comprises at least one conveying unit configured to pull a watercraft located on the ramp out of the water.

18. The recovery apparatus of claim 1 wherein the dimension of the deformable body in at least a direction that is perpendicular to the watercraft traveling onto the ramp in the direction of travel is able to be increased to a maximum dimension, in which the deformable body takes up at least half the width of the ramp frame.

19. The recovery apparatus of claim 18 wherein the recovery apparatus comprises a carrying structure and at least one flexible connecting element, wherein the at least one flexible connecting element is connected to the carrying structure and to the frame of the ramp, and wherein the deformable body is configured such that, at least when the ramp is in the recovering position, the deformable body enlarged to the maximum dimension tautens and/or tensions the flexible connecting element.

20. A ship comprising the recovery apparatus of claim 1.

21. The ship of claim 20 wherein the ship has an outer hull, and the ramp is movable from the recovering position into a parked position, wherein, when the ramp is in the parked position, the frame of the ramp terminates flush with the outer hull.

22. A method for recovering a watercraft from water using a recovery apparatus having a stationary carrying apparatus and a ramp that is movable relative to the stationary carrying apparatus, wherein the method comprises:

moving the ramp relative to the carrying apparatus into a recovering position, in which the ramp is located at least partially beneath a surface of the water;

moving the watercraft onto the ramp located in the recovering position;

lifting the watercraft from the water;

guiding the watercraft onto the carrying apparatus, wherein the ramp has a frame and a deformable body fastened to the frame, with the deformable body comprising at least one gas-fillable cavity, wherein the step of moving the ramp into the recovering position causes the deformable body to point toward the watercraft located in the water;

wherein, when the ramp has been moved into the recovering position, the deformable body is held at least partially above the surface of the water, and wherein the step in which the watercraft travels onto the ramp triggers an operation whereby the watercraft deforms the deformable body from above, wherein the method comprises delivering gas into the at least one gas-Tillable cavity of the deformable body at latest when the watercraft reaches the ramp.

23. The method as claimed in claim 22 wherein the step of moving the ramp into the recovering position and the step of delivering gas into the cavity are carried out in a temporally overlapping manner.

24. The method of claim 22 wherein the step of moving the ramp into the recovering position also causes the deformable body to float on the water, and the step in which the watercraft travels onto the ramp is carried out while the deformable body is floating on the water.

25. The method of claim 22 wherein the step of moving the ramp into the recovering position additionally causes the frame to be held under the surface of the water in a fixed position relative to the carrying structure, and causes at least a part of the deformable body to move upward relative to the frame, held under the surface of the water, of the ramp.

* * * * *